US008058541B2

(12) United States Patent
Taninbaum

(10) Patent No.: US 8,058,541 B2
(45) Date of Patent: Nov. 15, 2011

(54) PERCUSSION ACCESSORIES FOR DRUMSTICKS

(75) Inventor: Richard L. Taninbaum, Mamaroneck, NY (US)

(73) Assignee: Rhythm Tech Inc., New Rochelle, NY (US)

( * ) Notice: Subject to any disclaimer, the term of this patent is extended or adjusted under 35 U.S.C. 154(b) by 0 days.

(21) Appl. No.: 12/889,105

(22) Filed: Sep. 23, 2010

(65) Prior Publication Data

US 2011/0067554 A1 Mar. 24, 2011

Related U.S. Application Data

(60) Provisional application No. 61/295,020, filed on Jan. 14, 2010, provisional application No. 61/245,499, filed on Sep. 24, 2009.

(51) Int. Cl.
*G10D 13/02* (2006.01)

(52) U.S. Cl. ..... 84/422.4

(58) Field of Classification Search ..... 84/411 R, 84/453, 421
See application file for complete search history.

(56) References Cited

U.S. PATENT DOCUMENTS 2,466,554 A * 4/1949 Harry Mossey ..... 84/422.4
3,592,097 A 7/1971 Friede
5,044,250 A 9/1991 Beyer
5,265,514 A 11/1993 Schertz
5,477,768 A 12/1995 Swift
6,316,709 B1 11/2001 Nanberg et al.

* cited by examiner

*Primary Examiner* — Kimberly Lockett
(74) *Attorney, Agent, or Firm* — Lackenbach Siegel LLP; Myron Greenspan

(57) ABSTRACT

The accessory for a drum stick includes a pair of support members defining a parting plane and an elongate channel defined by elongated substantially parallel arcuate recesses on opposing sides of the parting plain. Biasing members, in the form of closed loops or rings, secure the support members and draw the support members together to minimize the cross-sectional dimensions of the elongate channel when the support members about against each other in a contracted condition. The cross-sectional dimensions of the elongate channel increase when the support members are separated and moved in opposing directions to an expanded condition, resulting in restoring forces in the biasing members that tend to revert the support members to the contracted condition. Sound producing elements are provided, such as steel shot within compartments formed in the supporting members or jingles attached to the support members. Insertion of a drum stick into the elongate channel separates the members and moves them from the contracted condition to an expanded condition against the action of the biasing members and the accessory can be reliably retained on the shaft of the drum stick as a result of frictional forces due to the restoring forces urging the support members against the drumstick. Hitting the drum stick as a percussion instrument provides additional sounds produced by the sound producing members, such as the steel shot or pellets or jingles.

20 Claims, 8 Drawing Sheets

PERCUSSION ACCESSORIES FOR DRUMSTICKS

CROSS-REFERENCE TO RELATED APPLICATIONS

This application is related to and claims priority of U.S. Patent Application No. 61/245,499 filed on Sep. 24, 2009 and U.S. Patent Application No. 61/295,020, filed on January 14, 2010.

BACKGROUND OF THE INVENTION

1. Field of the Invention

The invention generally relates to percussion instruments and, more specifically, to percussion accessories adapted to be attached or removed from drum sticks.

2. Description of the Prior Art

Drum sticks are objects that are typically used to strike drums or other percussion instruments to produce various sounds. The most widely used drum sticks are snare drum sticks usually made of wood, although other materials, including aluminum, nylon, plastic and cotton fiber have also been used. A typical drum stick is round 1.5 cm in diameter and 41 cm long, although drummers have wide range of shapes and sizes to choose from. Drummers sometimes are very particular about the exact shape, size, weight, balance, density and grain of the drum sticks they use as they all provide a different "feel" and sound the stick produces when it impacts on a percussion instrument.

There are numerous percussion accessories that have been proposed for use with drum sticks. While some such accessories, such cow bells, triangles and other percussion instruments are intended to be stricken with a drum stick, it has also been proposed that some percussion instruments be selectively mounted or supported on a drum stick while it is being used for striking another percussion instrument, such as a drum.

Thus, while drum sticks having a percussion component have been known (U.S. Pat. No. 6,316,709) none of these exhibit the simplicity and versatility demanded by drummers. Thus, the U.S. Pat. No. 2,466,554 discloses a combination drum stick and Maraca. The '554 patent discloses a device that includes two diametrically opposite openings for the passage of a drum stick. Each opening is surrounded on the interior of the ball by means of a sleeve-like flange that may be cemented or otherwise permanently secured to the drum stick. The patent, therefore, contemplates a permanently fixed connection with the maraca accessory. Clearly, this limits the ability to use the drum sticks by themselves or to modify or change the positions of the accessory after initial attachment.

U.S. Pat. No. 3,592,097 patent discusses a percussion assembly consisting of a pair of symbols that are mounted on a clamp that can be adjusted and secured by a wing bolt 15. This device is not convenient to use and can damage the drum stick since the free or lower end of the threaded shank applies a compression force to the drum stick while it rotates, thus exerting forces that can stress and damage the drum stick.

U.S. Pat. No. 5,477,768 discusses a multi-purpose drum ball joint simulator that essentially consists of a spherical ball made of rubber or other elastic material with a diametrical channel extending through it to provide a ball grip to be held in the palm of a hand to balance the drum stick and provide enhanced performance. However, while the ball joint stimulator is intended to be slid onto a drum stick and frictionally engage the drum stick shaft, it does not include any percussion component or create any additional percussion sounds while a drum stick is used to strike a drum or the like.

U.S. Pat. No. 6,316,709 discloses an adaptable percussion accessory or percussion tool. The percussion accessory uses attachment clamps or the like for attaching a percussion accessory to a drum stick. The clamps are used to attach a support to the drum stick, and a sound device such as a jingle is movably attached to the support. The jingles are moved and produce sounds when the user uses the drum stick on, for example, a drum. The patent also discloses a muffle device and a lever for muffling the sound when actuated when the user moves the lever. However, the disclosed percussion accessory is complex in construction and requires a tool to secure the accessory to the drum stick, such a screw driver or pliers to tighten the fasteners on the spaced clamps. Without the availability of such tools, therefore, the percussion accessory may not be readily removed from the drum stick when needed or desired to do so, thereby limiting the usefulness of the drum sticks and/or the percussion accessory.

Another jingle percussion accessory is known that uses a molded circular rigid plastic frame that supports jingles about its circumference and is provided with two aligned diametrically opposite holes for receiving the shaft of a drum stick. The holes have internal diameters greater than the external diameters of the shafts of the drum sticks so that any drum sticks having a smaller diameter than the diameter of the holes can be readily inserted through the holes to position the jingle accessory on the shaft of the drum stick. In order to secure the accessory to the drum stick a pair of generally radial set screws are used of the type having a hexagonal opening or socket at one end and a pointed tip at the other end. Although such set screws are typically used to fix two hard metallic members to each other the tip ends when used with a wooden drum stick penetrates the stick and forms depressions or holes on the surface. While such set screws prevent axial or sliding movements of the accessory relative to the axial direction of the drum stick, it also weakens the shaft and can promote breakage of the stick when the stick experiences substantial stresses when it impacts against a percussion instrument. Also, the use of two or four set screws on each accessory requires an Allen wrench or "Hex" key to drive or loosen the set screw. Such keys or wrenches are relatively small and can be easily misplaced or lost. Furthermore, the tightening or loosening of the set screws is an inconvenient and time consuming exercise—not one likely to be performed by a drummer, for example, in the middle of a concert. Therefore, effectively, the accessory will either be left off or left on the drum sticks and not selectively mounted on or removed from the drum sticks given different or varying musical requirements. The alternative is for a drummer to have multiple drum sticks some of which permanently carry the accessories while others do not.

SUMMARY OF THE INVENTION

Accordingly, it is an object of the invention to provide percussion accessories that do not have the disadvantages of known percussion accessories.

It is another object of the invention to provide percussion accessories that are simple in construction and economical to manufacture.

It still another object of the invention to provide percussion accessories that can be conveniently and quickly placed on or removed from a drum stick.

It is yet another object of the invention to provide percussion accessories as in the previous objects that do not require any tools or other devices for securing the same to the drum sticks.

It is yet another object of the invention to provide percussion accessories that are universal and can be as easily and quickly mounted on or removed from drum sticks of different sizes with the same ease and convenience.

It is a further object of the invention to provide percussion accessories of the type under discussion that are light in weight and can be used for extended periods of time without resulting in excessive fatigue to the user.

It is still a further object of the invention to provide percussion accessories as in the previous objects that are sturdy and resistant to breakage.

It is yet a further object of the invention to provide percussion accessories as in the previous objects that automatically and securely attach to the drum sticks when mounted thereon and that resist movements relative to the drum sticks along their axial lengths during normal use.

BRIEF DESCRIPTION OF THE DRAWINGS

The above and other objects, features and advantages of the present invention will be better understood from the following specification when read in conjunction with the accompanying drawings.

DETAILED DESCRIPTION OF A PREFERRED EMBODIMENT

Figure 1:
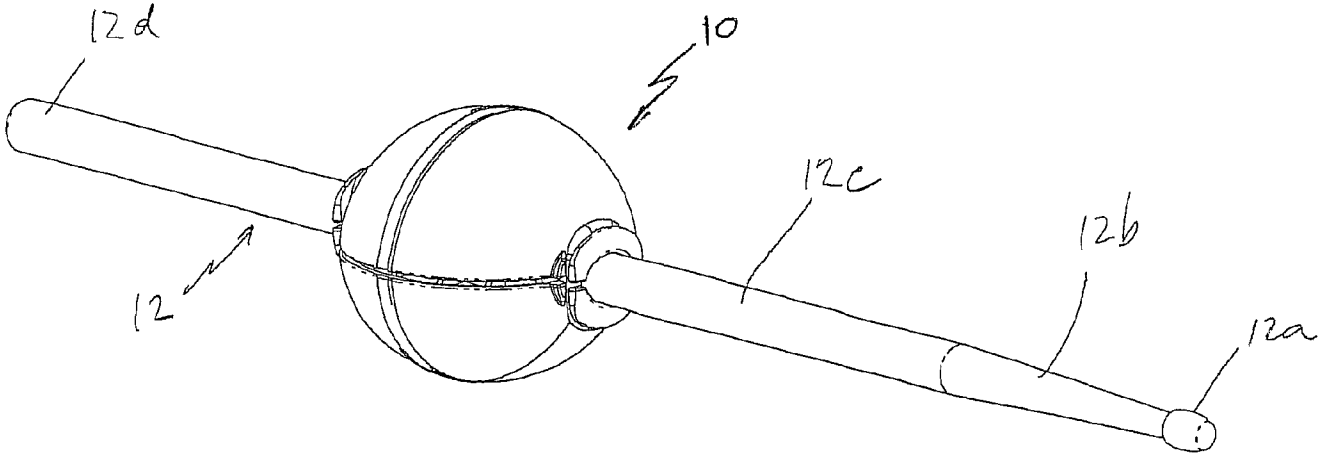
FIG. 1 is a perspective view of one presently preferred embodiment of a percussion accessory for a drum stick, shown mounted on a drum stick and ready for use.
Figure 2:
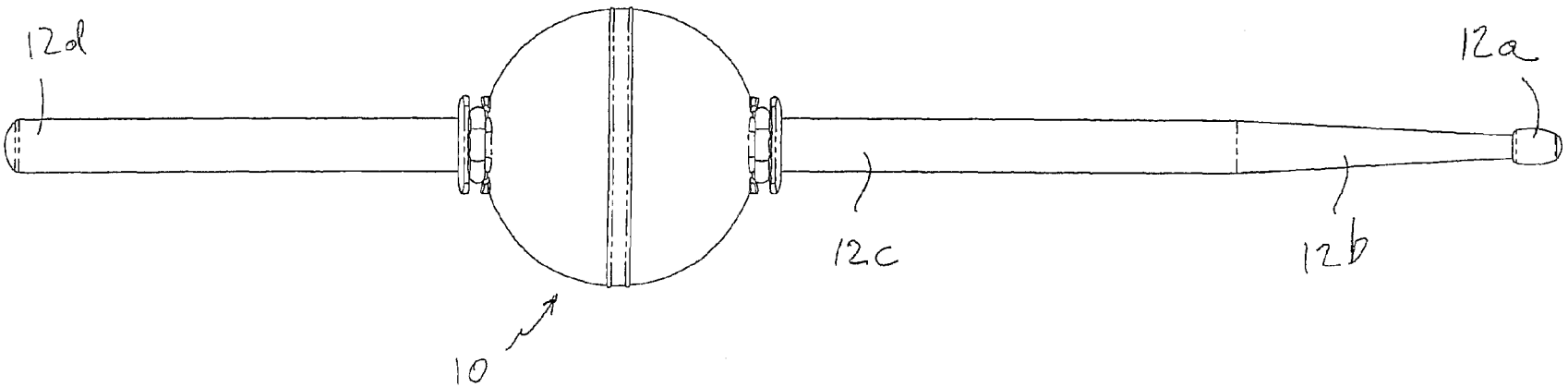
FIG. 2 is a side elevational view of the accessory and drum stick shown in FIG. 1.
Figure 3:
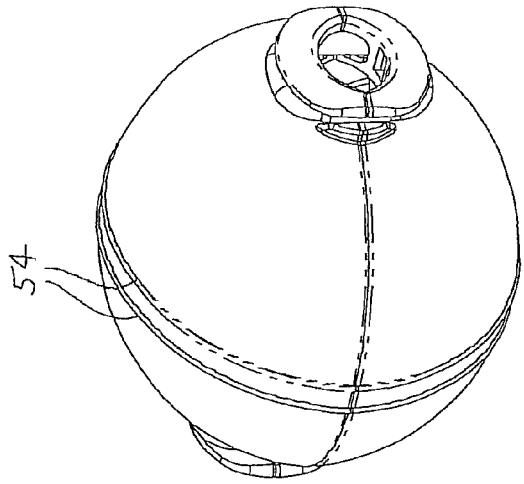
FIG. 3 is a perspective view of a percussion accessory shown in FIGS. 1 and 2, in its fully relaxed condition prior to being mounted on a drum stick.

Referring to the Figures, in which the identical or similar parts will be designated by the same reference numerals throughout, and first referring to FIGS. 1 and 2, one presently preferred embodiment of the accessory in accordance with the invention is generally designated by the reference numeral 10.

The accessory 10 is primarily intended to be used with a drum stick 12, commonly known as a snare drum stick typically made of wood, although other materials such as aluminum, fiberglass, nylon, acrylic, plastic and carbon fiber have been used. With some materials, such as aluminum, such drum sticks are sometimes covered with a PVC sleeve to avoid damage to cymbals or the like. There are different sizes of drum sticks for different situations, as well known to those skilled in the art, sometimes designated by a letter and a number, e.g. 2*b*, 5*b*, 5*a* and 7*a* to designate different weights. As will become evident from the description of follows, the percussion accessories in accordance with the invention are universal and they can be used in connection with different size drum sticks and, certainly, the common sizes most often used.

A snare drum stick of the type shown in FIGS. 1, 2 includes a tip 12*a*. While tips come in many shapes, this is not critical, as the radial dimensions of the tips are typically not the largest typical dimensions of the drum sticks. Immediately adjacent the tip 12*a* is a shoulder 12*b* that has the smallest dimension proximate to the tip 12*a* and tapers out to smoothly transition with the shaft 12*c*. The end of drum stick, opposite to the tip 12*a*, is sometimes referred as the "butt". The percussion accessories in accordance with the invention are intended to be used with snare drum sticks of the type having the general configuration as described. It will be noted, in this connection, that the shaft 12*c* is of generally uniform diameter from the transition point where it meets the taper 12*b* all the way to the end or butt 12*d*. As suggested above, however, while the cross-sectional dimensions of the shaft 12*c* is substantially constant and uniform throughout its length, it will be appreciated that the shafts of different drum sticks may have different uniform dimensions and exhibit smaller or larger diameters.

Figure 5:
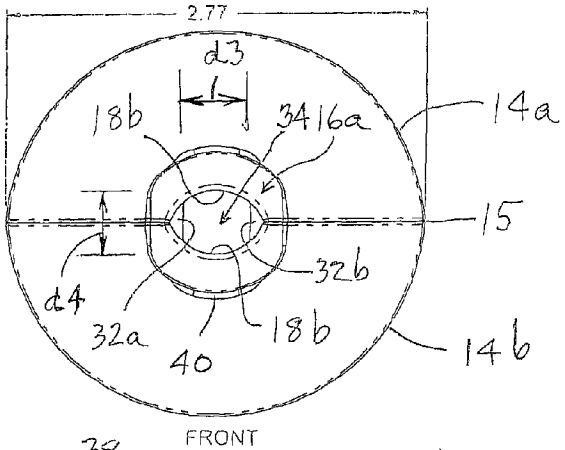
FIG. 5 is a front elevational view of the percussion accessory shown in FIGS. 3 and 4.
Figure 4:
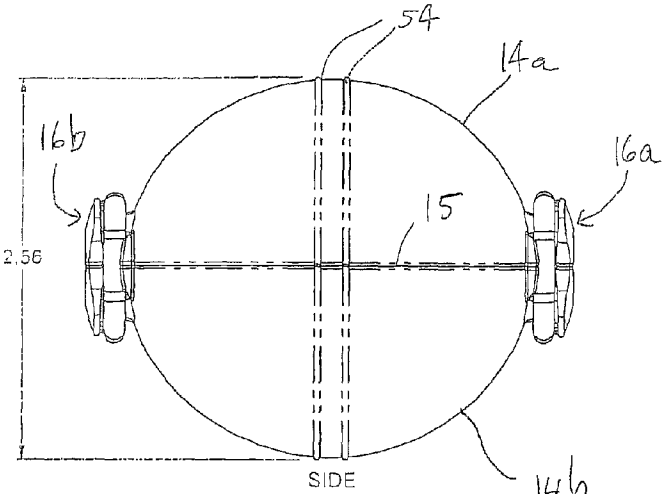
FIG. 4 is a side elevational view of the percussion accessory shown in FIG. 3.
Figure 6:
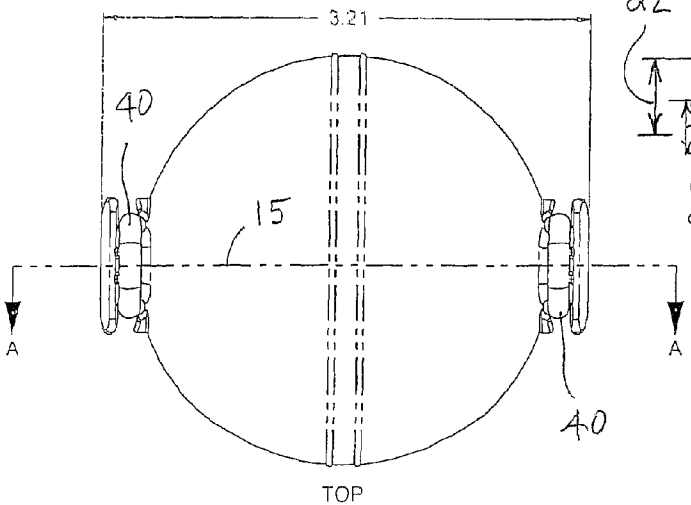
FIG. 6 is a top plan view of the percussion accessory shown in FIGS. 3-5.
Figure 9:
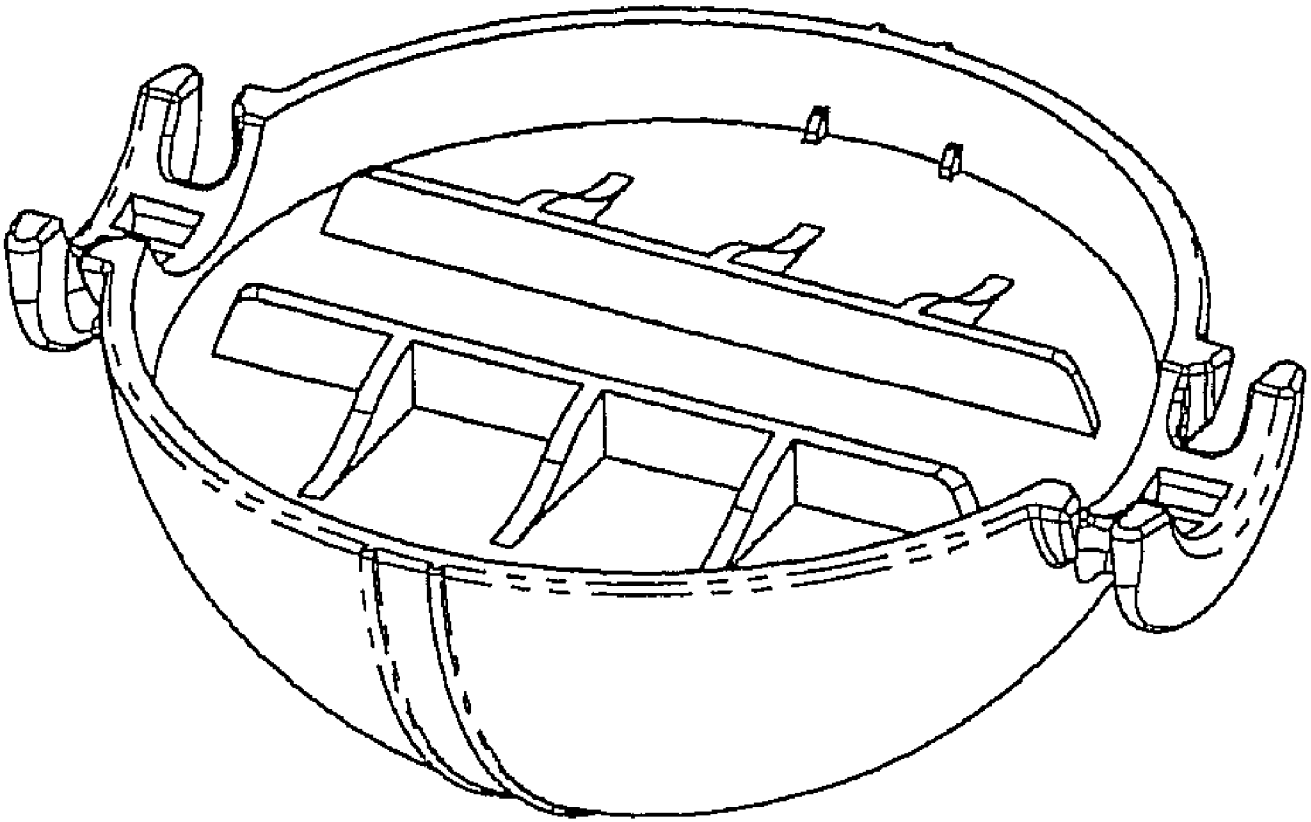
FIG. 9 is a perspective view of the lower shell shown in FIG. 8, in its assembled state.

Referring to FIGS. 1-9, the accessory 10 is shown to include generally symmetrical upper and lower shells 14*a* and 14*b*, as viewed in the Figures, that are generally in the form of hemispheres that meet, when assembled, at a parting line or equatorial plane 15. (FIGS. 4, 6).

Provided at the diametrically opposite ends are offset lips 16*a*, 16*b* at the front and rear of the accessory 10, as viewed in the Figures, that are respectively connected by means of ribs 17 to create contours shown in the form of circular arcs. The spacing of the offset lips 16*a*, 16*b* from the exterior surface of the shells 14*a*, 14*b* creates upper and lower arcuate channels 20*a*, 20*b*, to be described more fully below.

Figure 8:
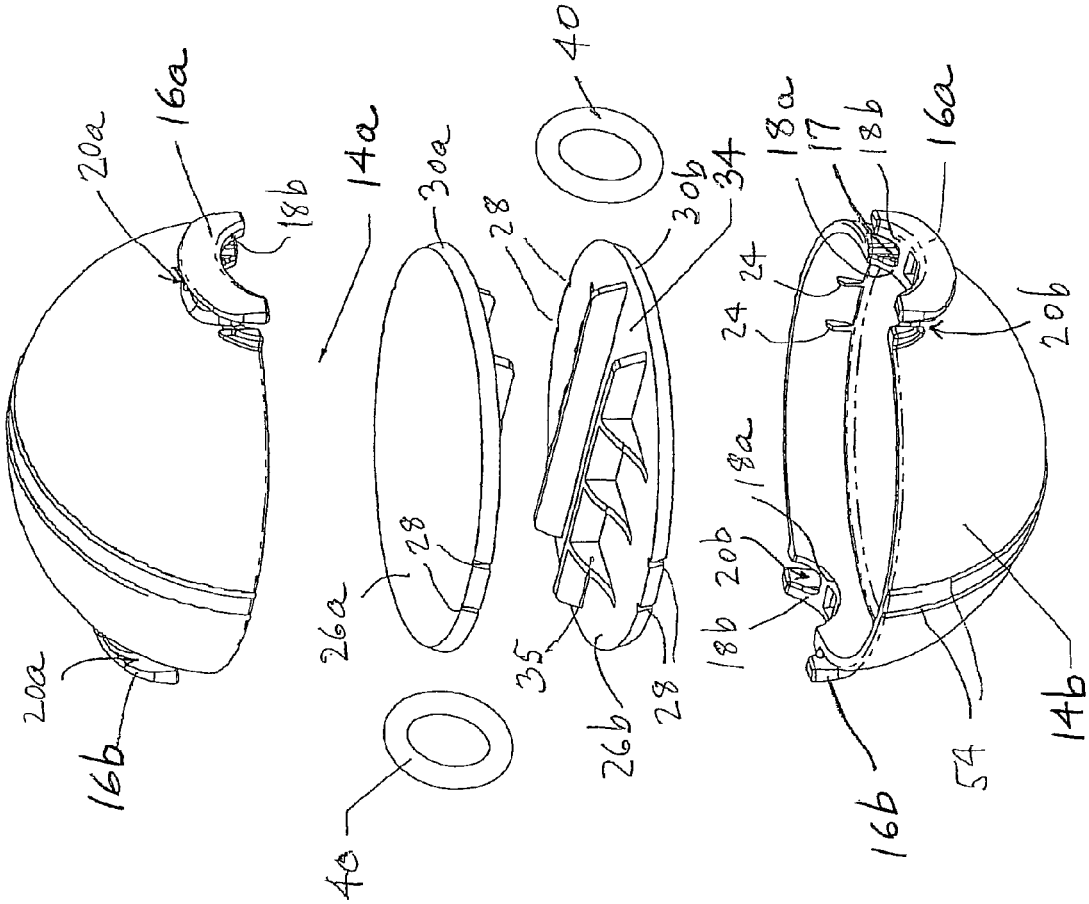
FIG. 8 is an exploded view of the percussion accessory shown in FIGS. 1-7.
Figure 7:
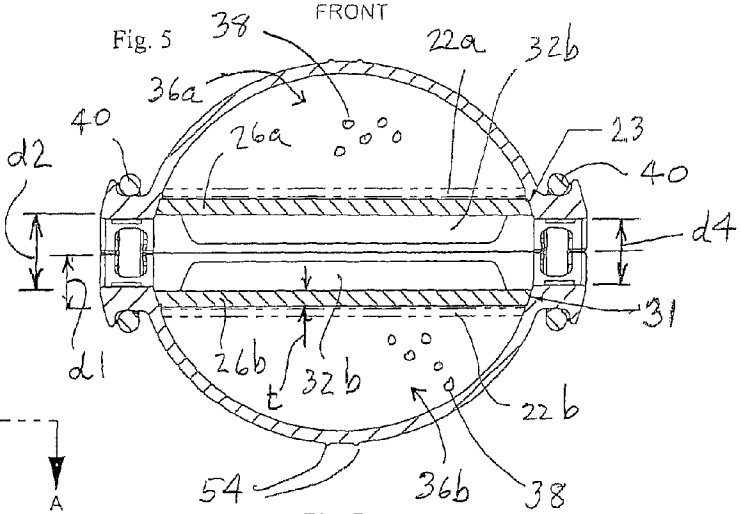
FIG. 7 is a cross-sectional view of the percussion accessory shown in FIGS. 1-6, as viewed along A-A in FIG. 6.

Spaced above and below the parting line 15 are upper and lower positioning planes 22*a*, 22*b* (FIG. 7) that are substantially parallel to each other. Circular ridges 23 extend about the line of intersection between the positioning planes 22*a*, 22*b* and the interior surface of the shells (FIG. 7). Positioning tabs 24, best shown in FIG. 8, are provided about the circular ridges 23, a pair of such positioning tabs being spaced on diametrically opposite sides in the shown embodiment. However, it will be clear that any number of such positioning tabs may be used.

Upper and lower plates 26*a*, 26*b* are provided each associated with another one of the shells 14*a*, 14*b*. The upper and lower plates are shown to be circular to conform to the interior surface of the shells along the upper and lower positioning planes 22*a*, 22*b* and are, therefore, circular as shown. Slots of grooves 28 are provided in the outer periphery of each of the plates 26*a*, 26*b* that are dimensioned and positioned to mate with the positioning tabs 24 to fix the plates within each of the associated shells. Each of the plates 26*a*, 26*b* is provided with conforming upper and lower tapers 38*a*, 38*b* to conform with the angular surfaces 31 (FIG. 7).

Provided on each of the lower and upper plates 26*a*, 26*b* are a pair of space transverse walls 32*a*, 32*b* that are generally parallel to each other and form an elongated channel 34. Optional transverse ribs 35 (FIG. 8) may be provided to strengthen the transverse walls 32*a*, 32*b*.

When the upper and lower plates 26*a*, 26*b* are placed within each of the associated shells, shown in FIG. 7, the plates are preferably secured in place by making the positioning tabs 24 in a form of snap fasteners that engage the slots of grooves 28. Alternatively, any suitable adhesive may be used on the upper and lower plates 30*a*, 30*b*, or annular surface 31 to more permanently attach the plates to the shells. Once the plates are secured in place, these form upper and lower compartments 36*a*, 36*b* suitable for receiving any hard, granular material such as dried seeds, pebbles or steel shot 38 (FIG. 7).

An important feature of the present invention is the use of elastic bands 40 shown, for example, in FIGS. 3-8 that are dimensioned to be received to within the upper and lower arcuate channels 20*a*, 20*b*. The dimensions of the elastic bands 40 are selected so when placed within the channels they are elongated and stretched even when two shells are in contact with each other as shown in FIGS. 3-7. This insures that the elastic bands always apply forces on the shells to abut against each other in pressure relationship.

In use of the accessory 10, a drum stick 12 is inserted through the elongate channel 34 by first inserting the tip 12*a* and then the shoulder 12*b* before finally positioning the accessory on the shaft 12*c* as shown in FIGS. 1 and 2. As best shown in FIGS. 5 and 7, the spacing of the positioning planes 22*a*, 22*b* are a distance d1 from the parting line or equatorial plane 15. The spacing between upper and lower positioning plates 22*a*, 22*b* is equal to d2, which is substantially equal to spacing d3 between the spaced transverse walls 32*a*, 32*b*. The dimensions d2, d3 are selected to receive most commonly sized drum sticks in the elongate channel 34. However, the resulting apertures formed by the accurate contours 18*a*, 18*b* are such so as to create a football-shaped openings at the opposite diametrical ends of the elongate channel 34, in which the dimension d4 is generally smaller than the dimensions d2, d3. The dimension d4 is selected to be smaller than the smallest diameter drum sticks contemplated to be used with the accessory. In this way, a drum stick forced through the channel 34 causes the shells to be separated against the biasing forces of the elastic bands 40. Once the accessory is secured on the shaft 12*c* of the drum stick the enlarged diameter of the shaft and the resulting stretching of the elongate bands 40 creates a compression of the drum stick with resulting friction that maintains the accessory in a selected position. The elastic bands are selected to provide suitable frictional forces to maintain an accessory in a selected position on the shaft of a drum stick while allowing a user to overcome that friction and remove the accessory from the drum stick by manually sliding it against the action of the friction either over the shoulder and tip or over the butt of the drum stick thereby removing it.

Decorative ribs 54, shown, for example, in FIGS. 4, 6 and 7, may be optionally provided, which ribs also provide strength and integrity to the generally thin wall forming each of the shells.

Figure 10:
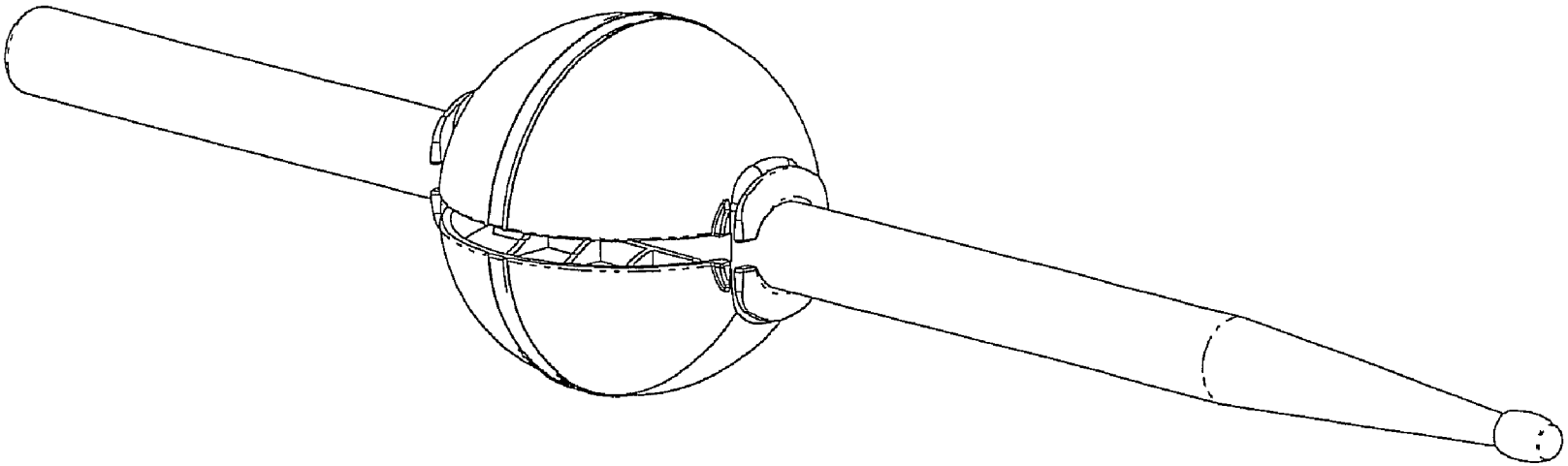
FIG. 10 is similar to FIG. 1, but shown in an intermediate stage during which the percussion accessory is being mounted onto a drum stick and the shells forming the same are slightly separated from each other.

In FIG. 10, the accessory is shown at an intermediate position in which the shells 14*a*, 14*b* are pulled apart axially relative to the drum stick to minimize or eliminate the frictional forces with the drum stick. This, however, is normally not necessary or essential and a user can simply force the drum stick through the channel 34 and overcome any frictional forces that may result from such relative sliding action between a drum stick and an accessory.

Figures 11, 12:
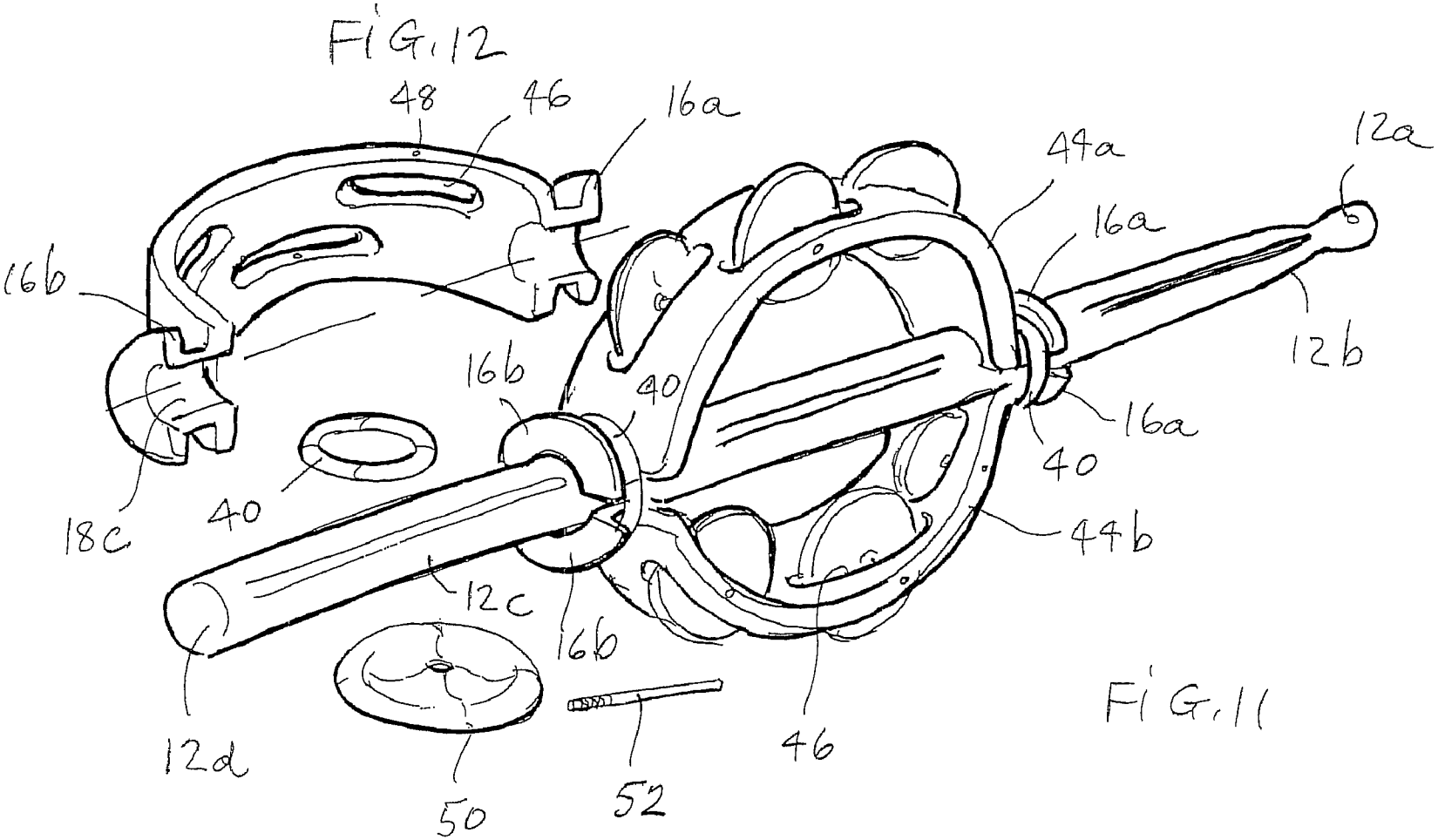
FIG. 11 is a perspective view of a second preferred embodiment of a percussion accessory, shown mounted on a drum stick and ready for use.
FIG. 12 is a perspective view of one of the accurate support members forming the accessory shown in FIG. 11 and showing some details thereof.
Figure 13:
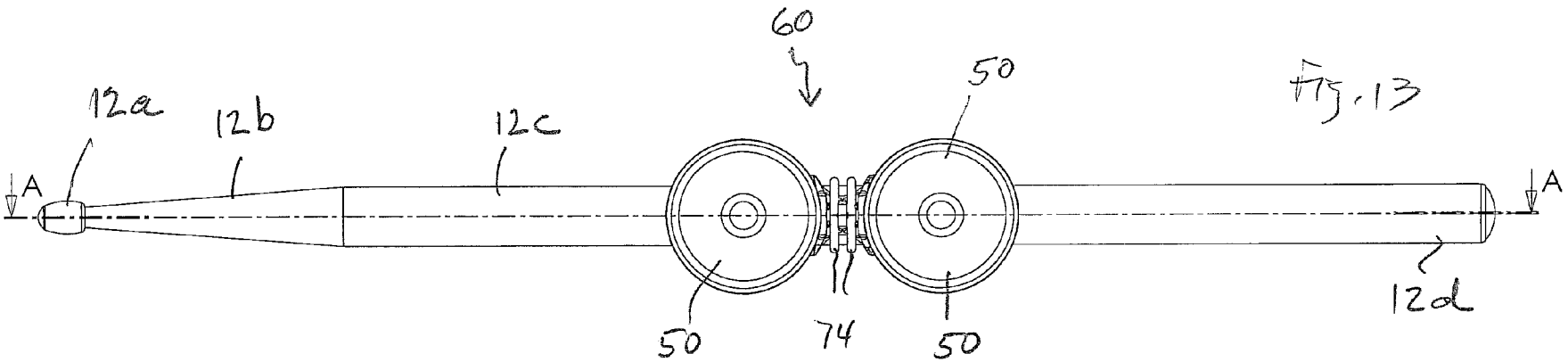
FIG. 13 is a side elevational view of a third preferred embodiment of a percussion accessory, shown mounted on a drum stick and ready for use.
Figure 14:
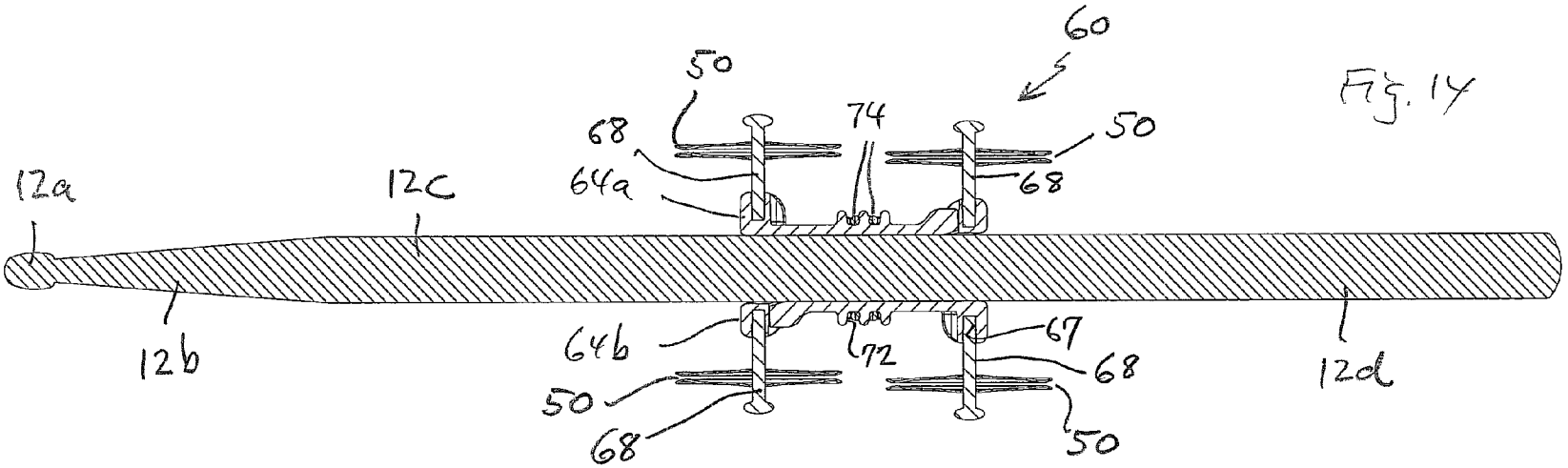
FIG. 14 is a longitudinal cross sectional view taken along A-A in FIG. 13.

Referring to FIGS. 11 and 12, a second presently preferred accessory in accordance with the invention is generally designated by the reference numeral 42. The accessory 42 includes accurate frame support members 44*a*, 44*b*, each generally in the shapes of semi-circular support members. Each of the frame support members is provided with a series of slots 46 as shown and transverse holes 48 associated with each of the slots 46 so that jingles 50 may be inserted within the slots and secured by inserting transverse pins 52. Similar accurate contours are 18*c* provided at the ends of each of the accurate frame support members, offset lips 16*a*, 16*b* being provided as with the first embodiment 10 to provide upper lower accurate channels 20*a*, 20*b* for receiving elastic bands 40 as previously described. It will be appreciated that the accessory 42 may likewise be readily placed on or removed from a drum stick as described.

Figure 15:
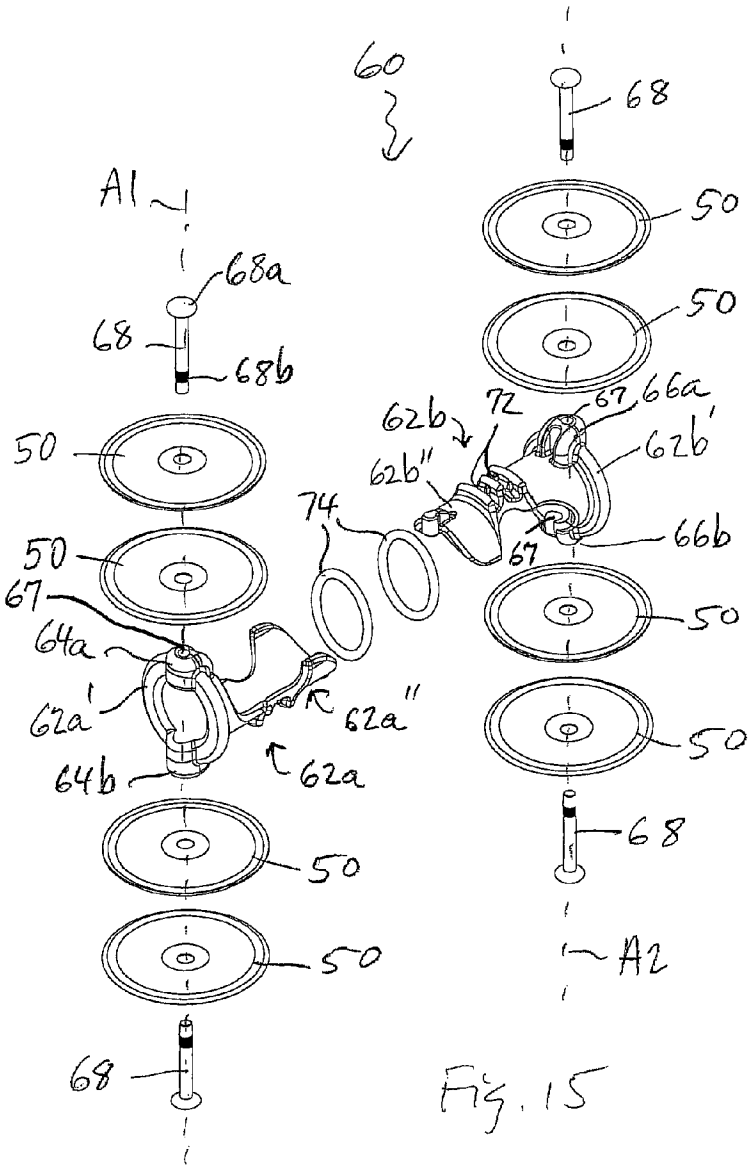
FIG. 15 is an exploded view of the percussion accessory shown in FIGS. 13 and 14.

Referring to FIGS. 13-17 a third preferred embodiment of the percussion accessory is illustrated in which the biasing elements or "O"-rings are applied centrally of the accessory as opposed to the axial ends as shown in FIGS. 11 and 12. The third embodiment is generally designated by the reference numeral 60 and is comprised of a cylindrical sleeve that is split into two sections 62*a*, 62*b*, as best shown in FIG. 15. The sections 62*a*, 62*b* are generally similar to each other as shown and include annular sections 62*a*', 62*b*' at the axially remote ends spaced furthest from each other and partial cylindrical sections 62*a*", 62*b*" that are generally diametrically juxtaposed to each other when assembled as shown in the Figures. The internal diameters of the annular ends 62*a*', 62*b*' are selected to correspond to the diameters of the largest portions of the drum sticks for which the accessory is intended to be used with. Thus, while the remote ends 62*a*', 62*b*' are generally rigid and cannot expand in the radial direction, it is clear that the proximate ends 62*a*", 62*b*" can move closer towards each other or be separated further from each other, for reasons that will be evident from the description of follows.

Each of the remote ends 62*a*', 62*b*' are provided with diametrically opposite enlarged portions or bosses 64*a*, 64*b*, 66*a*, 66*b* (FIG. 15) that generally define spaced parallel axes A1, A2 (FIG. 15). Each of the bosses is provided with longitudinal channels 67 aligned along the aforementioned axes. Pins 68 are provided with enlarged heads 68*a* and preferably with textured ends 68*b* provided that are embedded within the longitudinal apertures or channels 67 within the bosses 64*a*, 64*b*, 66*a*, 66*b*. The pins 68 may be press fit or molded within the channels and retained or prevented from separating therefrom by means of the textured ends 68*b*.

Figure 16:
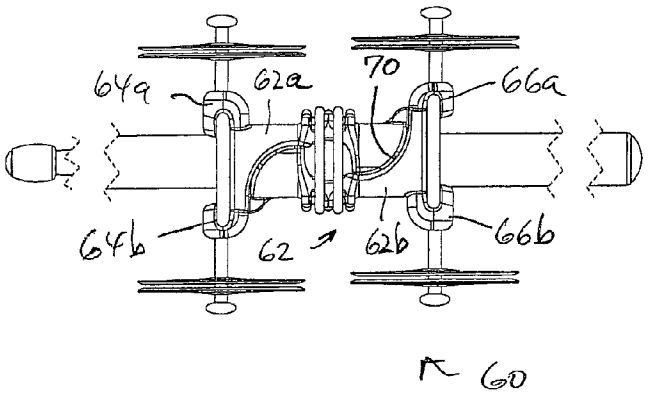
FIG. 16 is a top view of the percussion accessory shown in FIGS. 13 and 14, illustrating the relative positions of the split sleeve sections forming the accessories, shown in a state of expansion on a predetermined diameter end of the drum stick.
Figure 17:
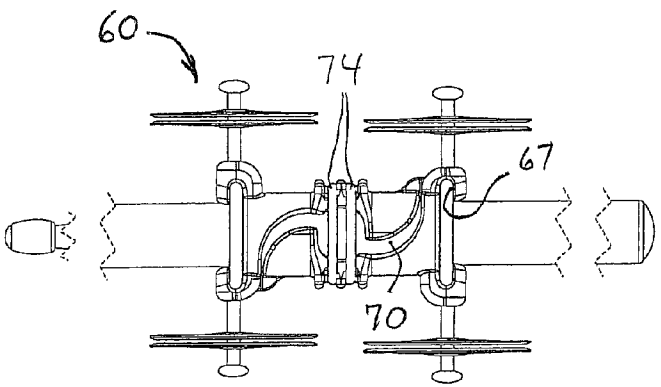
FIG. 17 is similar to FIG. 16 but showing the split sleeve sections in a state if greater radial expansion on a portion of a drum stick having a large diameter than that shown in FIG. 16.

Each of the cylindrical sections 62*a*, 62*b* is provided, at intermediate positions of the remote and proximate ends with one or more circumferential channels 72 as shown, these channels being generally aligned when the accessory is assembled, as best shown in FIGS. 13, 14, 15, 16 and 17. The channels, once aligned, receive "O"-rings 74 that have diameters generally smaller than the effective diameters of the channels 72 when the cylindrical sections are assembled thereby tending to draw the proximate ends 62*a*", 62*b*" towards each other. As indicated in FIGS. 16 and 17, when a drum stick is initially inserted within the accessory, the proximate ends 62*a*", 62*b*" are initially at a predetermined radial distance from each other. However, when a larger diameter portion of the drum stick is forced into the accessory 60, the proximate ends are forced to separate, against the biasing actions of the "O"-rings. The tension placed on the "O"-rings causes them to apply radially inward forces on the drum stick shaft that create sufficient frictional forces along the longitudinal or axial direction of the drum stick to prevent undesired relative sliding movements of the accessory along the drum stick during use. In the illustrated embodiment, two sets of channels 72 and two corresponding "O"-rings 74 are shown although it will be clear that one or more "O"-rings may be used, with different degree of advantage.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A percussion accessory for attachment to a drumstick having a striking tip at one free end and a butt at an opposing free end, a tapered shoulder proximate to said striking tip and a substantially uniform shaft between the tapered shoulder and the butt end, the accessory comprising:

a pair of generally symmetrical support members defining a parting plane and forming an elongate channel defining an axis and arranged on opposite sides of said parting plane, said elongate channel having a dimension along a direction generally normal to said axis that is adjustable from a first dimension less than the maximum cross-sectional dimension of the shaft to a second dimension that is at least equal to the maximum cross-sectional dimension of the shaft;

biasing means for drawing said support members towards each other and towards said axis to normally reduce said channel dimension to said first dimension; and sound producing members mounted on at least one of said support members, whereby the percussion accessory can be mounted on a shaft of a drumstick by inserting the drumstick through said channel along said axis and urging said support members to radially separate against the action of said biasing means and causing the percussion accessory to frictionally engage the surface of the drumstick as a result of restoring forces in said biasing means to thereby reliably secure the accessory to the drumstick and provide additional sounds when the drumstick is struck against a surface.

2. A percussion accessory as defined in claim 1, wherein each support member of said pair is generally in the shape of a hemisphere, said support members being arranged to together generally form a sphere.

3. A percussion accessory as defined in claim 2, wherein said hemispheres are each generally hollow shells that are closed by circular plates substantial at equatorial planes to form enclosed compartments, said sound producing members comprising pellet-like particles maintained in at least one of said compartments.

4. A percussion accessory as defined in claim 3, wherein said pellet-like particles are provided within said compartments of both said support members.

5. A percussion accessory as defined in claim 1, wherein each of said support members includes retaining portions proximate each axial end of said elongate channel extending beyond said cylindrical surfaces of said support members that form engaging elements, said biasing means comprising elastic bands dimensioned to encircle said engaging elements while being at least partially stretched to draw opposing engaging elements together.

6. A percussion accessory as defined in claim 1, wherein said first dimension of said elongate channel is at least equal to the cross-sectional dimensions of the striking tip of the drumstick, whereby the striking tip can initially be axially inserted into said elongate channel and said support members separated by using the tapered shoulder and subsequently the shaft of the drumstick into said channel to progressively increase the size of said channel by radially separating said support members against the action of said biasing means.

7. A percussion accessory as defined in claim 1, wherein said elongate channel has a longitudinal length along said axis of approximately 3¼ inches.

8. A percussion accessory as defined in claim 1, wherein said support members have an axial dimension of approximately 2½inches.

9. A percussion accessory as defined in claim 1, further comprising alignment means circular for aligning and maintaining a drumstick substantially arranged along said axis at all anticipated radial spacings of said support members from each other.

10. A percussion accessory as defined in claim 1, wherein each support member of said pair is generally an arcuate frame, said frames being generally arranged within a common plane, said elongate channel being defined by arcuate axial end portions of said frames, associated axial end portions on opposing frames being juxtaposed and proximate to each other.

11. A percussion accessory as defined in claim 10 wherein each of said frames is formed of a generally planar or flat strip of rigid material and formed with at least one slot, said sound producing members comprising at least one pair of jingles mounted within said at least one slot.

12. A percussion accessory as defined in claim 11, wherein both opposing arcuate frames are provided with slots and jingles mounted therein.

13. A percussion accessory as defined in claim 1, wherein said slots are generally parallel to said common plane and said jingles are mounted on pins oriented substantially normal to said common plane.

14. An accessory for a drumstick defining an axis and a shaft having a generally uniform diameter, comprising a pair of support members defining an elongate channel having an axis;

biasing means for normally drawing said support members together to minimize the cross-sectional dimensions of said elongate channel when said support members abut against each other in a contracted condition, said cross-sectional dimensions of said elongate channel increasing when said support members are separated and moved in opposing directions to an expanded condition, resulting in restoring forces in said biasing means tending to revert said support members to said contracted condition, said minimum cross-sectional dimension of said elongate channel being less than the uniform diameter of the drumstick; and sound producing members mounted on at least one of said support members, whereby insertion of a drumstick into said elongate channel separates said support members from said contracted condition to an expanded condition against the action of said biasing means and the accessory can be reliably retained on the shaft of the drumstick as a result of frictional forces due to said restoring forces, and using the drumstick as a percussion instrument provides additional sounds produced by said sound producing members.

15. A percussion accessory as defined in claim 14, wherein said support members define complimentary semi-cylindrical shells having a nominal diameter less than the diameter of the shaft of the drumstick.

16. A percussion accessory as defined in claim 14, wherein said biasing means acts at axially opposite ends of said semi-cylindrical shells.

17. A percussion accessory as defined in claim 14, wherein said biasing means acts at a point intermediate to the axially opposite ends of said semi-cylindrical shells.

18. A percussion accessory as defined in claim 17, wherein said sound producing members are mounted at opposite axial ends of said semi-cylindrical shells.

19. A percussion accessory as defined in claim 18, wherein said sound producing members comprise jingles mounted on pins projecting from said semi-cylindrical shells.

20. A percussion accessory as defined in claim 14, wherein said biasing means comprises at least one elastic band.

* * * * *